US005704140A

United States Patent [19]

Fields

[11] Patent Number: 5,704,140

[45] Date of Patent: Jan. 6, 1998

[54] TRAINING DEVICE

[76] Inventor: George S. Fields, 4123 Williamsburg Rd., Cincinnati, Ohio 45215

[21] Appl. No.: 751,302

[22] Filed: Nov. 18, 1996

[51] Int. Cl.[6] ..... A43B 7/19; A43B 7/20

[52] U.S. Cl. ..... 36/132; 36/136

[58] Field of Search ..... 36/88, 89, 114, 36/132, 136, 110, 142, 143, 144

[56] References Cited

U.S. PATENT DOCUMENTS

| | | | |
|---|---|---|---|
| 2,847,769 | 8/1958 | Schlesinger | 36/144 |
| 4,461,104 | 7/1984 | Calkin et al. | 36/132 |
| 4,774,775 | 10/1988 | Pruitt | 36/132 |
| 4,821,432 | 4/1989 | Reiber | 36/132 |
| 4,982,737 | 1/1991 | Guttmann | 36/110 |

FOREIGN PATENT DOCUMENTS

| | | | |
|---|---|---|---|
| 2932855 | 2/1981 | Germany | 36/34 R |
| 595791 | 2/1978 | Switzerland | 36/132 |

*Primary Examiner*—Paul T. Sewell
*Assistant Examiner*—Anthony Stashick
*Attorney, Agent, or Firm*—Steven J. Rosen

[57] ABSTRACT

A training device has a ramp means to be worn on a bottom of a sole of a shoe which has an upper section with toe and heel portions and an ankle portion above the heel portion. The sole has longitudinally spaced apart heel and toe sections and the training device and the ramp means having an underside contoured to be placed against the bottom of the sole. The ramp means has, in substantially longitudinal serial relationship, a ramp down section, a parallel section, and a ramp up section. The ramp down section ramps away from the underside in a heel to toe direction with reference to the shoe. The parallel section has a parallel surface that is substantially parallel to a plane defined by the underside and longitudinally extends from the ramp up surface in the heel to toe direction. The ramp up section ramps away from the parallel surface to the underside. The training device includes a shoe attaching means for attaching the ramp means to the shoe and the ramp means has a longitudinal length shorter than the sole. The training device may further include an ankle support wrapped around the ankle portion of the shoe under a strapping means of the shoe attaching means. The parallel section of the ramp means may be positioned under an instep section of the shoe and the ramp down section may be positioned under a ball area of the sole which substantially corresponds to a position in the shoe for supporting a ball of the foot.

23 Claims, 4 Drawing Sheets

TRAINING DEVICE

BACKGROUND OF THE INVENTION

1. Field of the Invention

The present invention relates to training devices worn on the outside of athletic shoes for training while walking in order to strengthen calf muscles and, more particularly, to devices that are removably strapped to the bottom or sole of such shoes.

2. Discussion of the Background Art

A major amount of exercise and training is devoted to strengthening the calf muscles. Many shoes and devices have been developed which incorporate reverse slopes on the bottom of shoes to provide toe elevation which is stated to stretch the achilles tendon resulting in the ability to generate greater jumping force as the calf muscle contracts. One such device is disclosed in U.S. Pat. No. 5,491,912 which provides a device which places the heel significantly lower than the ball of the foot and toes. The patent also reviews many of the problems with prior art devices attempting to provide the similar benefits. However, reverse slope shoes are not conducive to walking or training because they are not compatible with the way people normally walk and run and interfere with the natural manner in which people walk.

Walking typically involves the heel contacting the ground first with a gradual roll onto the ball of the foot and then a lifting off of the ground with the toes from the same elevation. The contact and liftoff at the same elevation as the individual expects and is comfortable with is important for keeping the foot, ankle, body, back and spine, properly aligned to minimize strain and prevent an awkward and/or uncomfortable gait. Prior art devices for strengthening calf muscles cause an unnatural and unexpected contact and/or elevation between the shoe and the ground at the heel and liftoff at the toe of the foot.

SUMMARY OF THE INVENTION

The present invention is a training device having a ramp means to be worn on a bottom of a sole of a shoe which has an upper section with toe and heel portions and an ankle portion above the heel portion. The sole has longitudinally spaced apart heel and toe sections and the ramp means has an underside contoured to be placed against the bottom of the sole. The ramp means includes, in substantially longitudinal serial relationship, a ramp down section, a parallel section, and a ramp up section. The ramp down section has a ramp down surface which ramps away from the underside in a heel to toe direction with reference to the shoe. The parallel section is positioned between the ramp down and ramp up sections and has a parallel surface that is substantially parallel to a plane defined by the underside and longitudinally extends from the ramp up surface in the heel to toe direction. The ramp up section has a ramp up surface longitudinally extending from the parallel surface and which ramps away from the parallel surface to the underside in the heel to toe direction. The training device includes a shoe attaching means for attaching the ramp means to the shoe and the ramp means has a longitudinal length shorter than the sole. In one more particular embodiment, the longitudinal length of the ramp means is about fifty percent shorter than the sole length.

Preferably, the ramp up and ramp down surfaces have transversely extending ramp widths that are substantially narrower than a transversely extending middle width of the parallel surface the ramp means may be a block of hard elastomeric material. In one embodiment of the invention, the shoe attaching means has a first strapping means for wrapping over the shoe in a position above the parallel surface, a second strapping means for wrapping around and behind the ankle portion of the shoe, and the strapping means is attached to the ramp means such that the ramp down surface is positioned substantially in front of the heel.

In another embodiment of the invention, the training device includes a shoe having an upper section attached to the sole and the upper section having a heel portion and an ankle portion above the heel portion. The sole has longitudinally spaced apart heel and toe sections and the ramp means is mounted to the bottom of the sole. In a more particular embodiment, the shoe may have a longitudinally extending shoe length line extending substantially between backwardmost and forwardmost points of the sole and the ramp means may include transversely extending linear edges of the ramp up and ramp down surfaces and an orientation line normal to the linear edges. The ramp means is mounted to the bottom of the sole such that the orientation line is acutely angled with respect to the shoe length line.

In yet another embodiment of the invention, the training device further includes an ankle support wrap wrapped around the ankle portion of the shoe and under the second strapping means, a third strapping means attached to the support wrap for strapping to and wrapping around an ankle portion of the shoe, and a fourth strapping means attached to the support wrap for strapping under the sole of the shoe.

The training device may also include an instep section of the sole and shoe longitudinally disposed between the heel and toe sections and where the parallel section of the ramp means is positioned under the instep section. The sole may also further include a ball area which substantially corresponds to position the shoe for supporting a ball of the foot where the ball section is disposed in front of the instep section of the sole and the ramp down section is positioned under at least a substantial portion of the ball area.

ADVANTAGES OF THE INVENTION

Some of the advantages provided by the present include the ability of an individual to train and strengthen calf muscles while doing ordinary walking, exercising or other training while using the present invention with a minimal effect of intrusion into the individual's biomechanics of such an activity. The present invention provides a training devices which has the advantages of being worn on the outside of athletic or other type of shoe for training while walking in order to strengthen calf muscles. Another advantage of the present invention is that such a device can be easily strapped on to and unstrapped from the bottom or sole of a shoe. Yet another advantage of the present invention is that it strengthens muscles, particularly calf muscles, during ordinary walking and training with very little impact on the biomechanics of walking and other training. The present invention allows normal walking, running, jogging with very little interference with an individual's typical gait and walking motion. This involves the heel contacting the ground first with a gradual roll onto the ball of the foot and then a lifting off of the ground with the toes from the same elevation. The present invention is advantageous because it provides contact and liftoff of the foot at the same elevation as the individual expects, is used to, and/or is comfortable with and helps keep the foot, ankle, body, back and spine properly aligned to minimize strain and prevent an awkward and/or uncomfortable gait as well as a twisting or spraining of the ankle. The invention isn't thick and therefore is very unobtrusive on the bottom of the sole.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DETAILED DESCRIPTION

Figure 1:
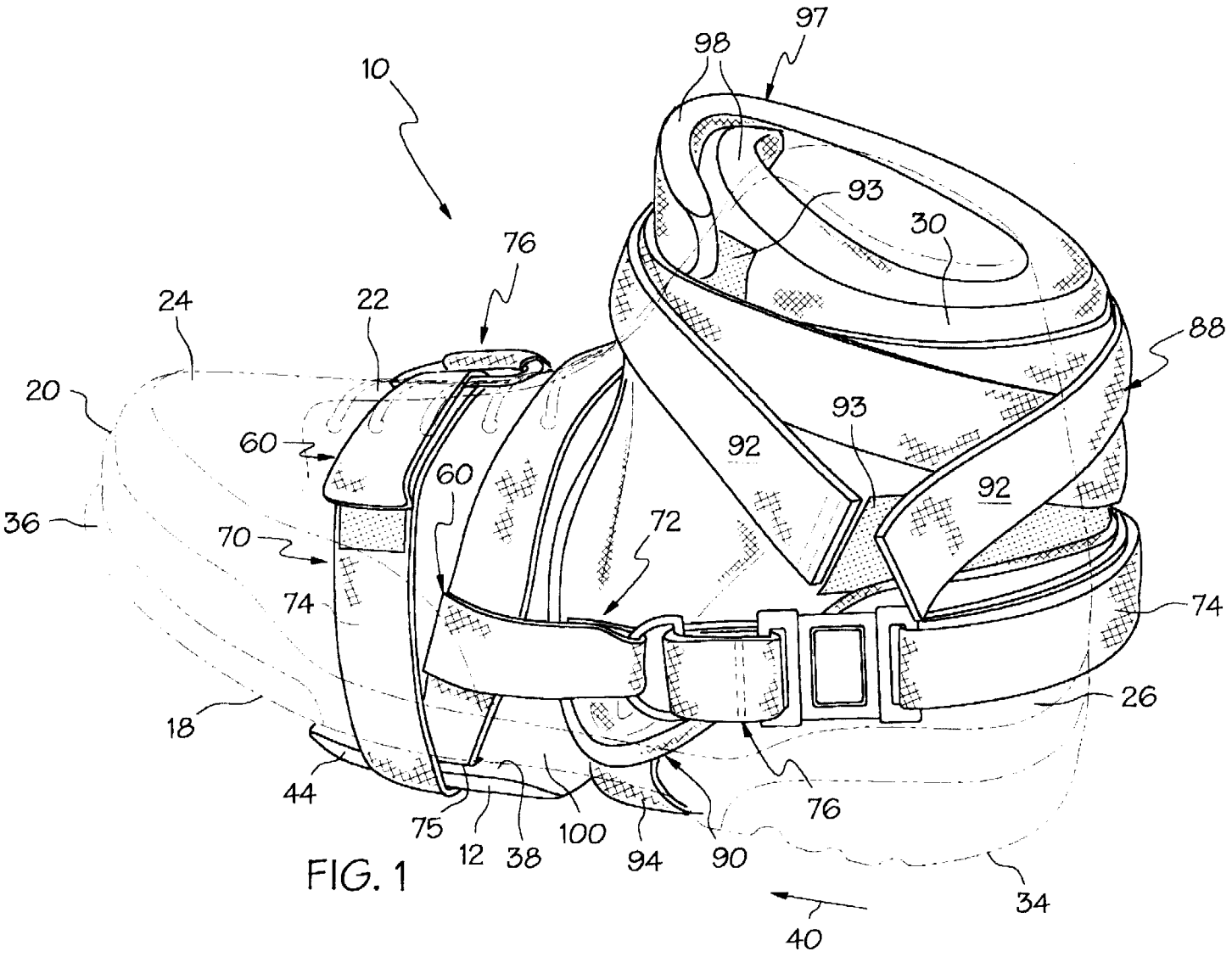
FIG. 1 is a perspective view of the training device in accordance with an exemplary embodiment of the present invention.
Figure 2:
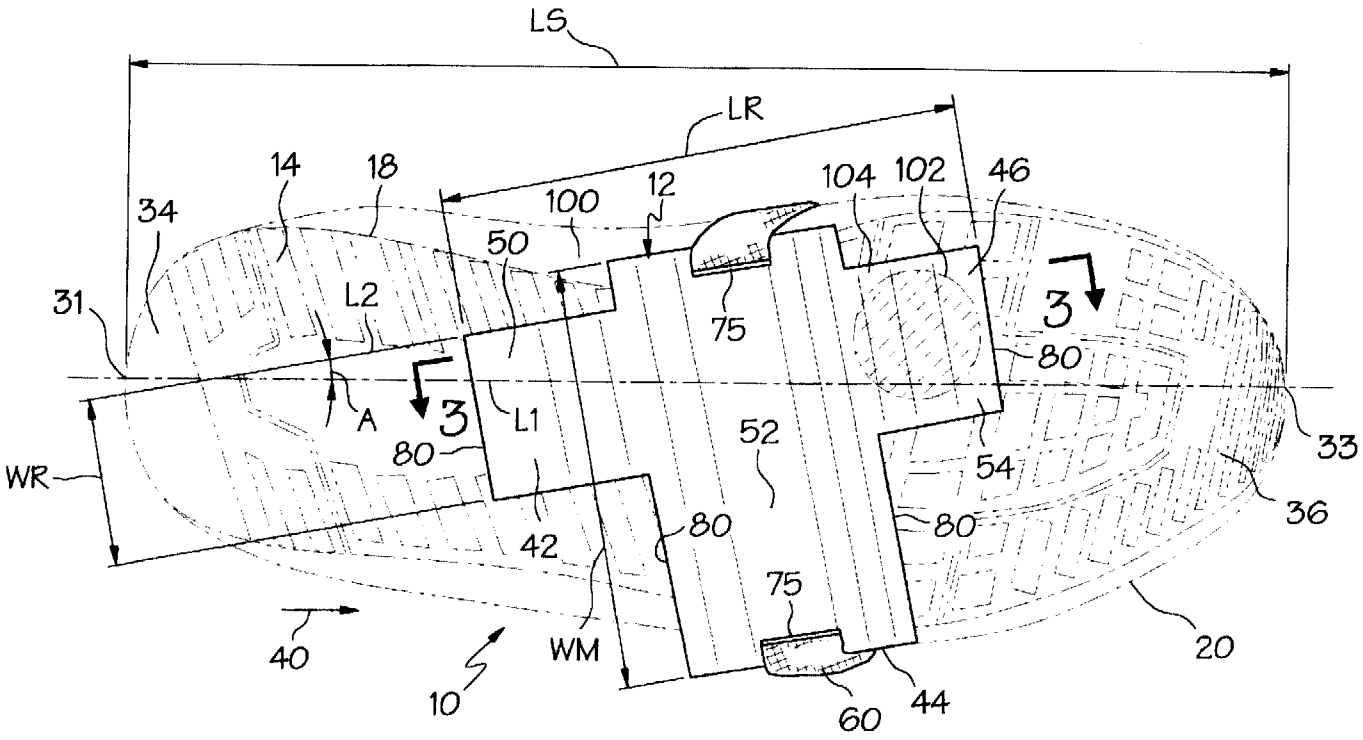
FIG. 2 is a perspective view of the present invention taken from below the sole of the shoe of the training device illustrated in FIG. 1.

Referring now to the drawings in detail wherein identical numerals indicate the same elements throughout the figures. FIGS. 1 and 2 illustrates an exemplary embodiment of the present invention which is a training device 10 having a ramp means 12 to be worn on and mounted to a bottom 14 of a sole 18 of a shoe 20, such as an athletic shoe, which has an upper section 22 with toe and heel portions 24 and 26, respectively, and preferably, an ankle portion 30 above the heel portion. The sole 18 has longitudinally spaced apart heel and toe sections 34 and 36, respectively, and the ramp means 12 has an underside 38 contoured to be placed against the bottom 14 of the sole.

Figure 3:
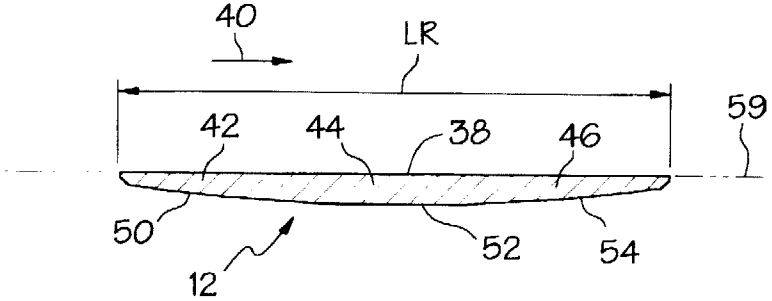
FIG. 3 is a cross-sectional view of the ramp means of the present invention taken through 3—3 in FIG. 2.

The ramp means 12 has, in substantially longitudinal serial relationship in a heel to toe direction 40 with reference to the shoe 20, a ramp down section 42, a parallel section 44, and a ramp up section 46, as further illustrated in cross-section in FIG. 3. The ramp down section 42 has a ramp down surface 50 which ramps away from the underside 38 in the heel to toe direction 40. The parallel section 44 is positioned between the ramp down section 42 and the ramp up section 46 and has a parallel surface 52 that is substantially parallel to a plane 59 defined by the underside 38 and longitudinally extends from the ramp down surface 50 in the heel to toe direction 40. The ramp up section 46 has a ramp up surface 54 longitudinally extending from the parallel surface 52 and which ramps up and away from the parallel surface to the underside 38 in the heel to toe direction. The training device 10 includes a shoe attaching means 60 for attaching the ramp means 12 to the shoe 20. The ramp means 12 isn't very thick and therefore is very unobtrusive on the bottom of the sole. The ramp means 12 is preferably about three eighths to one half inch thick and therefore isn't annoying during normal walking, running, and jogging and produces very little interference with an individual's typical gait and walking motion.

The ramp means 12 has a longitudinal ramp length LR shorter than a longitudinal sole length LS as measure between heel and toe tips 31 and 33 of the heel and toe sections 34 and 36, respectively, of the sole 18. In one more particular embodiment, the ramp length LR is about fifty percent shorter than the sole length LS. The ramp down and ramp up surfaces 50 and 54, respectively, are preferably substantially flat and planar, having transversely extending ramp widths WR which, though not necessarily equal, are substantially narrower than a transversely extending middle width WM of the parallel surface 52 which preferably is substantially flat and planar. The ramp means may be made in the form of a block of hard elastomeric material.

The exemplary embodiment of the invention illustrated in the FIGS. provides the shoe attaching means 60 with a first strapping means 70 for wrapping over the shoe in a position above the parallel surface 52, a second strapping means 72 for wrapping around and behind the ankle portion 30 of the shoe 20, and the first and second strapping means are attached to the ramp means 12 such that the ramp down surface 50 is positioned substantially in front of the heel section 34 of the sole 18. The first and second strapping means 70 and 72, respectively, have straps 74 and buckling means such as Velcro buckle assemblies 76 illustrated in the FIGS. or some other securing apparatus to secure the ramp means 12 to the shoe 20. In the illustrated embodiment, the first strapping means 70 is attached to the ramp means 12 by the straps 74 of the first strapping means disposed through slots 75 in the parallel section 44 of the ramp means. The second strapping means 72 is attached to the ramp means 12 by being attached in a generally perpendicular direction to the straps 74 of the first strapping means 70.

The ramp means 12 is preferably canted or angled with respect to the sole 18 of the shoe 20. This is illustrated in FIG. 2 as an acute angle A between a first line L1 between the heel and toe tips 31 and 33, respectively, and a second line L2 along which ramp length LR lies. L1 is a longitudinally extending shoe length line extending substantially between backwardmost and forwardmost points of the sole 18 corresponding to the heel and toe tips 31 and 33, respectively. The ramp means 12 in a rectangular platform form as illustrated in FIG. 2 has transversely extending linear edges 80 of the ramp up surface 54 and the ramp down surface 50 and L2 is an orientation line normal to the linear edges. The ramp means 12 is mounted to the bottom of the sole such that the orientation line is acutely angled with respect to the shoe length line for the purpose of providing a counter force vector to that caused by the toes. The wearer's toes are attached to the foot along an angle is not perpindicular to the first line L1 between the heel and toe tips 31 and 33, respectively. This produces an undesirable force vector to the outside of the shoe, away from the instep of the shoe. The ramp means 12 is acutely angled with respect to the shoe length line in an opposite direction to produce a counter force vector in a direction to the inside of the shoe towards the instep of the shoe. This helps to increase the stability of the foot and direct maximum energy towards the calf and other muscles of the leg which in turn promotes strengthening and development of these muscles.

Figure 4:
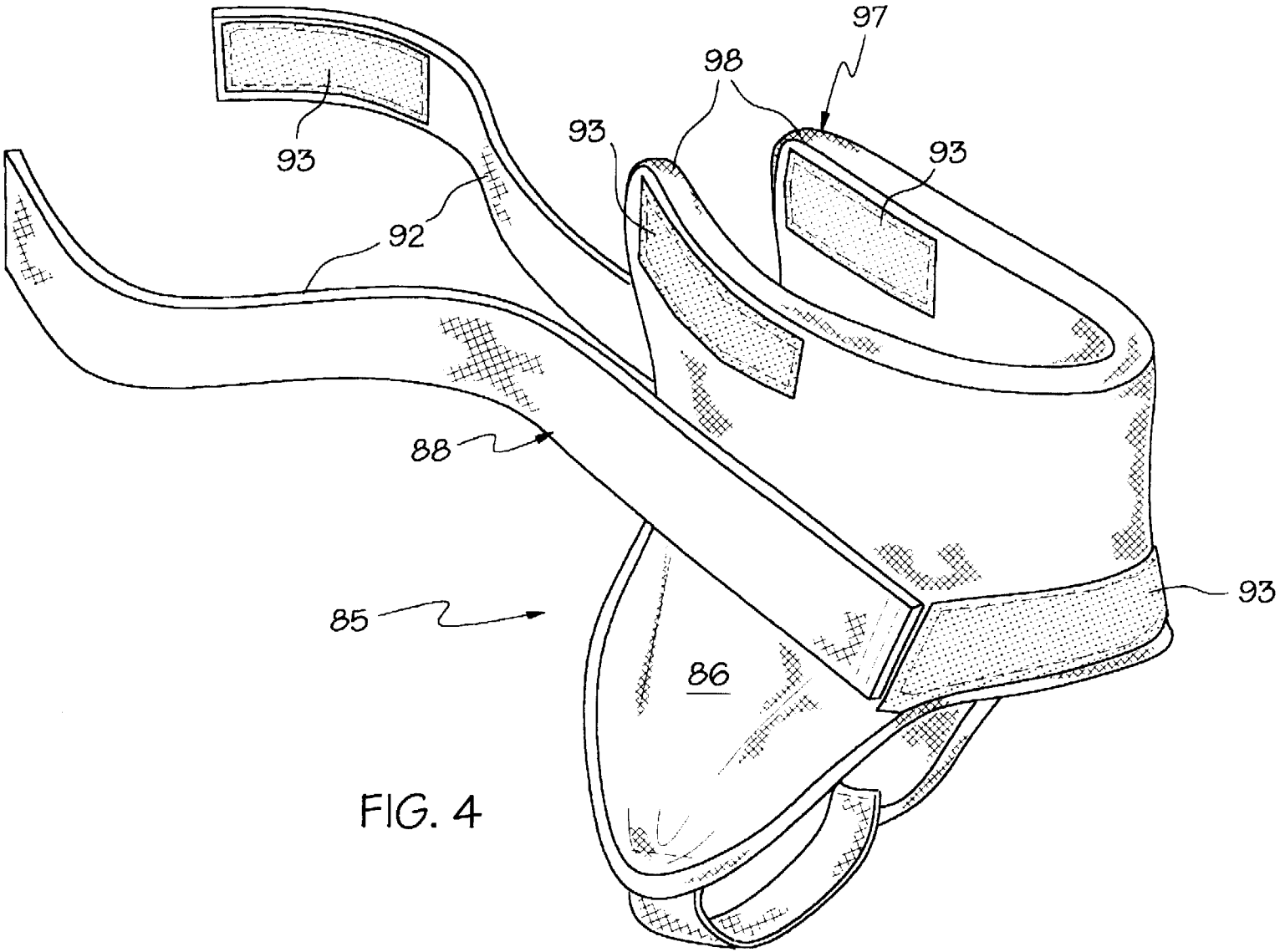
FIG. 4 is a perspective view of the ankle support wrap wrapped around the ankle portion of the shoe illustrated in FIG. 1.
Figure 5:
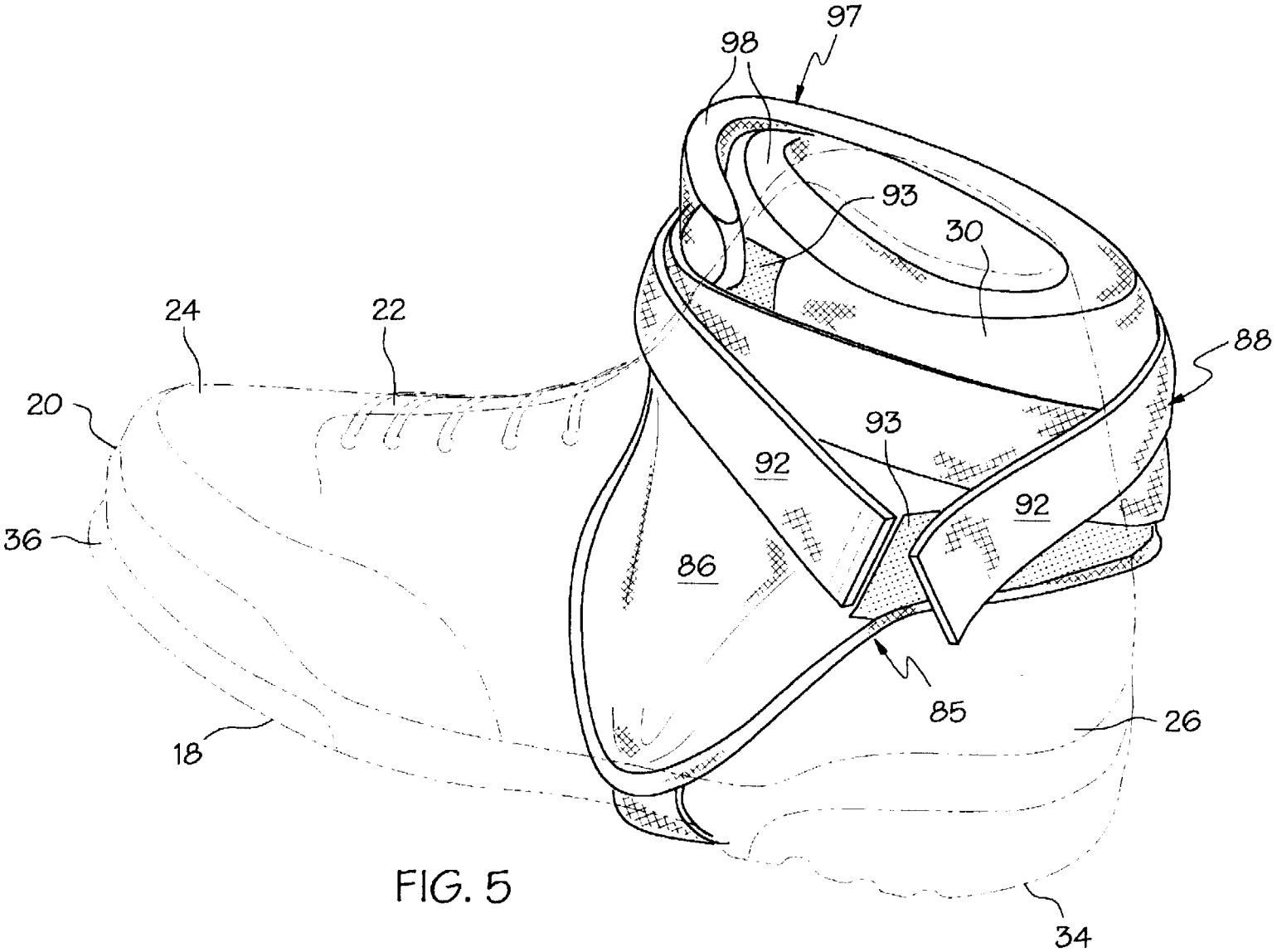
FIG. 5 is a perspective view of the ankle support wrap illustrated in FIG. 4.

Illustrated in FIGS. 1, 4 and 5 is another aspect of the training device of the present invention is to provide ankle support means 85 with a pliable ankle support wrap 86 which may be made of nylon or canvas wrapped around the ankle portion 30 of the shoe 20. The ankle support wrap 86 is preferably disposed under the second strapping means 72 and has a third strapping means 88 for attaching the support wrap to the shoe 20 and wrapping the support wrap around the ankle portion 30 of the shoe 20. Preferably, the third strapping means 88 has overlapping straps 92 with Velcro 93 used to secure the overlapping straps in place. A fourth strapping means 90 preferably having an elastic strap 94 is attached to the ankle support wrap 86 for strapping under the sole 18 of the shoe 20. A flap attachment means 97 includes padded extension flaps 98 of the ankle support wrap 86 which are overlapped and secured together by another set of mating Velcro 93 strips.

A more particular embodiment of the training device 10 includes an instep section 100 of the sole 18 and shoe 20 where the instep section is longitudinally disposed between the heel and toe sections 34 and 36, respectively, of the sole and where the parallel section 44 of the ramp means 12 is positioned under the instep section. The sole 18 may also further include a ball area 102 which substantially corresponds to position the shoe 20 for supporting a ball of the foot where the ball section is disposed in front of the instep section 100 of the sole 18 and the ramp down section 42 of the ramp means 12 is positioned under at least a substantial portion 104 of the ball area 102. This helps guide and align the foot properly for the contact and liftoff with the ramp means strapped onto the shoe. This also helps guide and align the foot for a comfortable and natural biomechanical movement and/or flexure of the foot and the foot and leg muscles, gait and stride of the user.

While the preferred embodiment of our invention has been described fully, in order to explain its principles, it is understood that various modifications or alterations may be made to the preferred embodiment without departing from the scope of the invention as set forth in the appended claims.

I claim:

1. A training device to be worn on a bottom of a sole of a shoe, the shoe having an upper with toe and heel portions and an ankle portion above the heel portion, and the sole having longitudinally spaced apart heel and toe sections, said training device comprising:

a ramp means having an underside contoured to be placed against the bottom of the sole, said ramp means having in substantially longitudinal serial relationship a ramp down section, a parallel section, and a ramp up section, said ramp down section has a ramp down surface which ramps away from said underside in a heel to toe direction with reference to the shoe, said parallel section is positioned between said ramp down and ramp up sections and has a parallel surface that is substantially parallel to a plane defined by said underside and longitudinally extends from said ramp up surface in said heel to toe direction, said ramp up section has a ramp up surface longitudinally extending from said parallel surface and which ramps away from said parallel surface to said underside in said heel to toe direction, a shoe attaching means for attaching said ramp means to the shoe, and said ramp means having a longitudinal length shorter than the sole, and said ramp up and down surfaces have transversely extending ramp widths that are substantially narrower than a transversely extending middle width of said parallel surface.

2. A training device as claimed in claim 1 wherein said ramp means is shorter than the sole and said strapping means is attached to said ramp means such that said ramp down surface is positioned substantially in front of the heel.

3. A training device as claimed in claim 2 wherein said ramp means further comprises a block of hard elastomeric material.

4. A training device as claimed in claim 1 wherein said shoe attaching means comprises:

a first strapping means for wrapping over the shoe in a position above said parallel surface, a second strapping means for wrapping around and behind the ankle portion of the shoe, and said strapping means is attached to said ramp means such that said ramp down surface is positioned substantially in front of the heel.

5. A training device as claimed in claim 4 wherein said ramp means is shorter than the sole and said strapping means is attached to said ramp means such that said ramp down surface is positioned substantially in front of the heel.

6. A training device as claimed in claim 5 wherein said ramp means further comprises a block of hard elastomeric material.

7. A training device comprising:

a shoe having an upper section attached to a sole, said upper section having a heel portion and an ankle portion above the heel portion, said sole having longitudinally spaced apart heel and toe sections, a ramp means mounted to a bottom of said sole, said ramp means having in substantially longitudinal serial relationship a ramp down section, a parallel section, and a ramp up section, said ramp down section has a ramp down surface which ramps away from said underside in a heel to toe direction with reference to the shoe, said parallel section is positioned between said ramp down and ramp up sections and has a parallel surface that is substantially parallel to a plane defined by said underside and longitudinally extends from said ramp up surface in said heel to toe direction, said ramp up section has a ramp up surface longitudinally extending from said parallel surface and which ramps away from said parallel surface to said underside in said heel to toe direction, a shoe attaching means for attaching said ramp means to said shoe, and said ramp means having a longitudinal length shorter than a sole length of said sole, and said ramp up and ramp down surfaces have transversely extending ramp widths that are substantially narrower than a transversely extending middle width of said parallel surface.

8. A training device as claimed in claim 7 wherein said strapping means is attached to said ramp means and said longitudinal length is such that said ramp down surface is positioned substantially in front of the heel.

9. A training device as claimed in claim 8 wherein said ramp means further comprises a block of hard elastomeric material.

10. A training device as claimed in claim 8 wherein said shoe attaching means comprises a first strapping means for wrapping over the shoe in a position above said parallel surface and a second strapping means for wrapping around and behind said ankle portion of said shoe.

11. A training device as claimed in claim 8 further comprising:

a longitudinally extending shoe length line extending substantially between backwardmost and forwardmost points of said sole, transversely extending linear edges of said ramp up and ramp down surfaces, an orientation line normal to said linear edges, and said ramp means mounted to said bottom of said sole such that said orientation line is acutely angled with respect to said shoe length line.

12. A training device as claimed in claim 11 wherein said ramp means further comprises a block of hard elastomeric material.

13. A training device as claimed in claim 11 wherein said shoe attaching means comprises a first strapping means for wrapping over the shoe in a position above said parallel surface and a second strapping means for wrapping around and behind said ankle portion of said shoe.

14. A training device as claimed in claim 8 wherein said longitudinal length of said ramp means is about fifty percent shorter than said sole length.

15. A training device as claimed in claim 14 further comprising:

a longitudinally extending shoe length line extending between backwardmost and forwardmost points of said sole, transversely extending linear edges of said ramp up and ramp down surfaces, an orientation line normal to said linear edges, and said ramp means mounted to said bottom of said sole such that said orientation line is acutely angled with respect to said shoe length line.

16. A training device as claimed in claim 15 wherein said ramp up and ramp down surfaces have transversely extending ramp widths that are substantially narrower than a transversely extending middle width of said parallel surface.

17. A training device as claimed in claim 16 wherein said shoe attaching means comprises a first strapping means for wrapping over the shoe in a position above said parallel surface and a second strapping means for wrapping around and behind said ankle portion of said shoe.

18. A training device as claimed in claim 17 further comprising:

an ankle support wrap wrapped around said ankle portion of said shoe and under said second strapping means, a third strapping means attached to said support wrap for strapping to and wrapping around an ankle portion of said shoe, and a fourth strapping means attached to said support wrap for strapping under said sole of said shoe.

19. A training device as claimed in claim 8 further comprising an instep section of said sole longitudinally disposed between said heel and toe sections and said parallel section is positioned under said instep section.

20. A training device as claimed in claim 19 wherein said sole includes a ball area which corresponds to a position said shoe for a ball of the foot, said ball section disposed in front of said instep section of said sole, and said ramp down section is positioned under at least a substantial portion of said ball area.

21. A training device as claimed in claim 20 further comprising:

a longitudinally extending shoe length line extending between backwardmost and forwardmost points of said sole, transversely extending linear edges of said ramp up and ramp down surfaces, an orientation line normal to said linear edges, and said ramp means mounted to said bottom of said sole such that said orientation line is acutely angled with respect to said shoe length line.

22. A training device as claimed in claim 21 wherein said shoe attaching means comprises a first strapping means for wrapping over the shoe in a position above said parallel surface and a second strapping means for wrapping around and behind said ankle portion of said shoe.

23. A training device as claimed in claim 22 further comprising:

an ankle support wrap wrapped around said ankle portion of said shoe and under said second strapping means, a third strapping means attached to said support wrap for strapping to and wrapping around an ankle portion of said shoe, a fourth strapping means attached to said support wrap for strapping under said sole of said shoe, and a flap attachment means having padded extension flaps extending from said ankle support wrap and that can be overlapped and secured together.

* * * * *